US007276157B1

(12) United States Patent
Woods

(10) Patent No.: US 7,276,157 B1
(45) Date of Patent: Oct. 2, 2007

(54) SWIMMING POOL STRAINER

(76) Inventor: Kenneth G. Woods, 2421 Breckenridge St., Tyler, TX (US) 75702

( * ) Notice: Subject to any disclaimer, the term of this patent is extended or adjusted under 35 U.S.C. 154(b) by 67 days.

(21) Appl. No.: 11/056,706

(22) Filed: Feb. 11, 2005

Related U.S. Application Data

(60) Provisional application No. 60/544,789, filed on Feb. 13, 2004.

(51) Int. Cl.
*E04H 4/12* (2006.01)
*B01D 29/17* (2006.01)

(52) U.S. Cl. ..... 210/167.19; 210/232; 210/416.2; 210/483; 4/507

(58) Field of Classification Search ..... 210/169, 210/232, 416.1, 416.2, 459, 483, 499, 167.19, 210/460; 4/496, 507
See application file for complete search history.

(56) References Cited

U.S. PATENT DOCUMENTS 3,784,019 A * 1/1974 Gordon, III ..... 210/486
4,889,622 A * 12/1989 Newcombe-Bond ..... 210/169
5,106,492 A * 4/1992 Distinti et al. ..... 210/91
5,833,845 A * 11/1998 Anderson ..... 210/169
5,863,310 A * 1/1999 Brown et al. ..... 55/480
5,935,450 A 8/1999 Benedict
D437,094 S 1/2001 Ward
6,214,217 B1 4/2001 Sliger, Jr.
6,270,683 B1 * 8/2001 Turner ..... 210/776
6,517,709 B1 * 2/2003 Cardwell et al. ..... 210/164
6,770,193 B2 8/2004 Foley
6,817,041 B1 11/2004 Evans et al.
2005/0011819 A1 * 1/2005 Gillen et al. ..... 210/121

* cited by examiner

*Primary Examiner*—Fred G. Prince
(74) *Attorney, Agent, or Firm*—Kenneth L Tolar

(57) ABSTRACT

A swimming pool strainer formed of a substantially U-shaped housing including an end panel with a pair of spaced side panels perpendicularly extending therefrom. Positioned between the side panels are a plurality of spacer dowels that enhance the structural integrity of the housing. An upper screen and a lower screen are secured to the upper and lower surfaces of the housing respectively. Free ends of the side panels are inserted into a swimming pool skimmer until a free edge of each screen abuts the swimming pool wall. Accordingly, the screens trap leaves and other large debris that would otherwise enter and damage a circulating filtering system.

9 Claims, 2 Drawing Sheets

SWIMMING POOL STRAINER

CROSS REFERENCE TO RELATED APPLICATIONS

This application is entitled to the benefit of provisional application No. 60/544,789 filed on Feb. 13, 2004.

BACKGROUND OF THE INVENTION

The present invention relates to a strainer for mounting within a swimming pool skimmer that prevents leaves and similar debris from entering the recirculating filtering system.

DESCRIPTION OF THE PRIOR ART

Most in-ground swimming pools are equipped with a recirculating filtering system for removing particulate matter from the water. Typically, the filtering system includes a plurality of skimmers peripherally disposed about the pool interior walls through which water flows to the filtering system. The skimmers are typically disposed at or immediately beneath the water's surface to effectively skim smaller debris therefrom. Inevitably, leaves, limbs and other large debris fall into the swimming pool, particularly in wooded areas. Such debris enters the filtering system via the skimmers thereby plugging the filter, pumps and/or piping which eventually renders the filtering system inoperable.

Numerous devices exist in the prior art that are purported to solve this problem. For example, U.S. Pat. No. 6,817,041 issued to Evans et al. discloses a skimmer guard including first and second brackets for positioning against opposite walls of a skimmer opening. A plurality of resilient ribs extend between the brackets for preventing objects from entering the skimmer.

U.S. Pat. No. 6,770,193 issued to Foley discloses an L-shaped pool skimmer barrier that is inserted into the skimmer. The barrier allows water to flow into the skimmer while blocking debris and similar objects.

U.S. Pat. No. D437,094 issued to Ward discloses an ornamental design for a pool skimmer screen.

U.S. Pat. No. 6,214,217 issued to Sliger, Jr. discloses an arcuate skimmer screen that is secured within a skimmer opening using a uniquely designed mounting bracket.

U.S. Pat. No. 5,935,450 issued to Benedict discloses a skimmer screen including rearwardly extending flanges for insertion into a skimmer opening.

Though many skimmer screens exist in the prior art, none include the features and advantages of the present invention. Specifically, the present invention includes a uniquely configured housing that can be simply inserted into a skimmer intake eliminating the need for brackets or other retaining means.

SUMMARY OF THE INVENTION

The present invention relates to a swimming pool strainer. The device comprises a substantially U-shaped base component including an end panel with a pair of parallel side panels perpendicularly extending therefrom. The side panels each terminate at a free end. Disposed between the side panels are two or more spacer dowels that enhance the structural integrity of the device. Attached to an upper surface of each side panel and end panel is a screen. The screen is fastened to the respective panels with elongated L-brackets. A lower screen is similarly fastened to the lower surfaces of the panels.

To install the above described device, the free ends of the side panels are inserted into a skimmer intake opening. Accordingly, any debris approaching the skimmers will be trapped on either the upper or lower screen preventing the debris from entering the filtering system.

It is therefore an object of the present invention to provide a swimming pool strainer that protects a recirculating filtering system.

It is another object of the present invention to provide a swimming pool strainer that prevents large debris from entering a swimming pool filtering system.

It is yet another object of the present invention to provide a swimming pool strainer that can be easily and quickly installed within a swimming pool skimmer intake.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
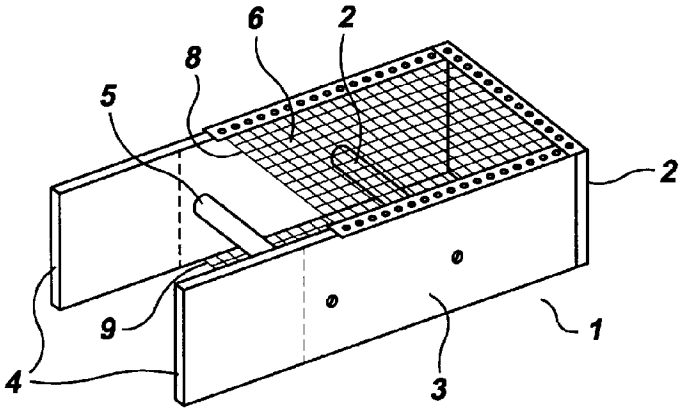
FIG. 1 is a perspective view of the strainer.
Figure 4:
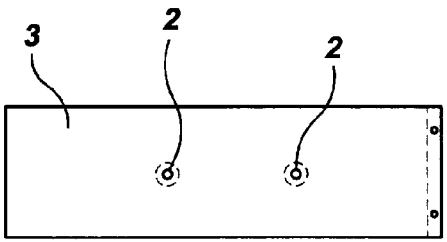
FIG. 4 is a side view of the strainer.
Figure 2:
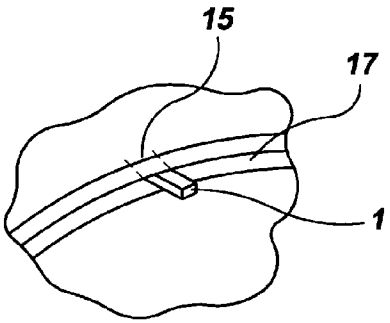
FIG. 2 depicts the strainer installed in a skimmer intake opening.
Figure 3:
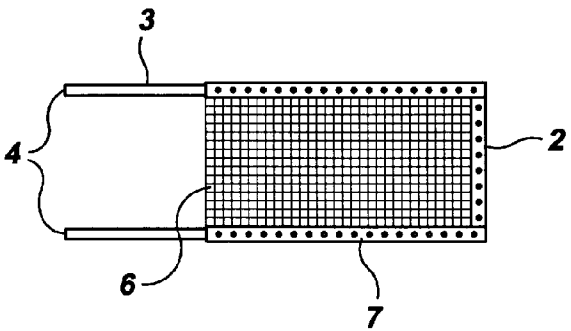
FIG. 3 is a top view of the strainer.

The present invention relates to a swimming pool strainer. The device comprises a substantially U-shaped base component 1 including an end panel 2 with a pair of parallel side panels 3 perpendicularly extending therefrom. The side panels each terminate at a free end 4. The side panels are spaced so as to tightly abut the opposed inner surfaces of a skimmer 17 intake 15 interior to firmly anchor the base component therein. Disposed between the side panels are two or more spacer dowels 5 that enhance the structural integrity of the device.

Attached to an upper surface of the base component is an upper screen 6. The screen includes four edges, three of which are secured to the side and end panels using elongated L-brackets 7, screen molding or a similar fastener. The fourth edge 8 is free. A lower screen 9 is similarly fastened to the lower surface of the base component.

Figure 6:
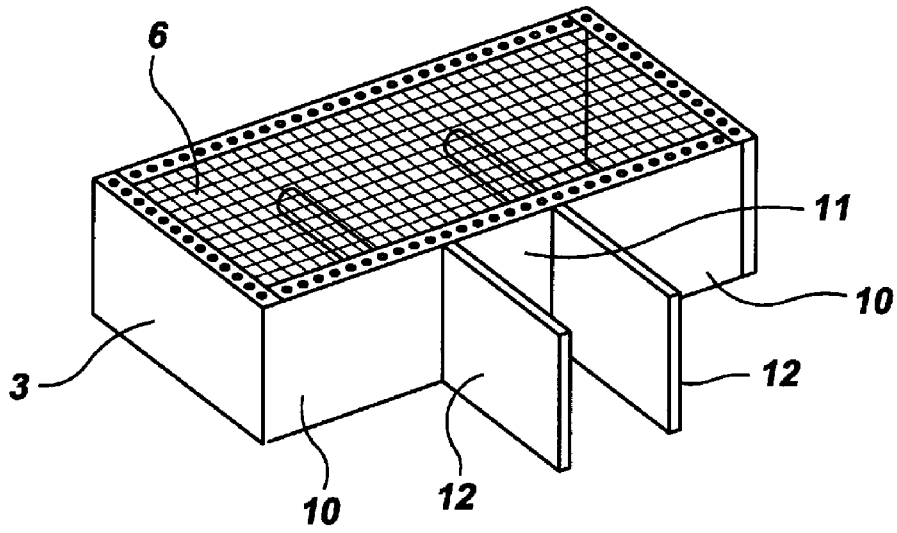
FIG. 6 depicts the embodiment of FIG. 5 with an upper screen mounted thereon.
Figure 5:
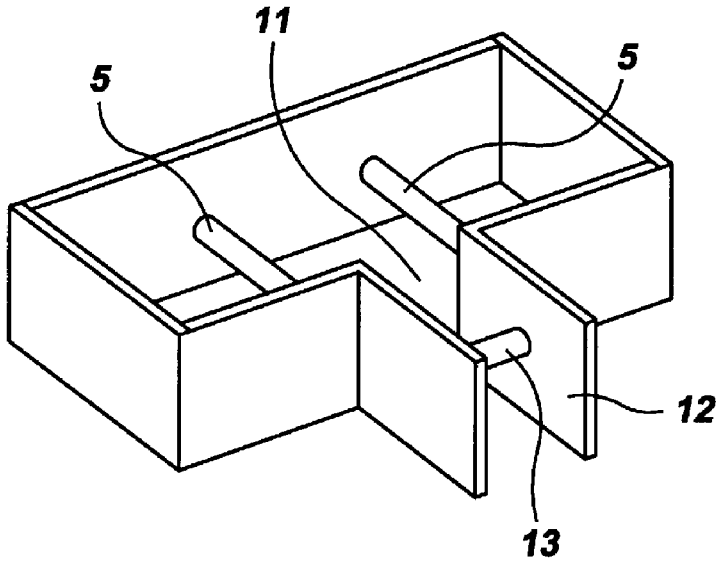
FIG. 5 is a perspective view of a slightly different embodiment than that depicted in FIGS. 1-4.

Now referring to FIGS. 5 and 6, a second embodiment includes a wall 10 inwardly extending from the free end of each side panel with a space 11 formed between distal ends thereof. Perpendicularly extending from the distal end of each wall is a flap 12. A dowel 13 may extend between the flaps to further reinforce the base component. The flaps are spaced and dimensioned so as to tightly fit within a swimming pool skimmer intake opening. The design of the second embodiment allows the housing to be much wider than the skimmer opening thereby providing a larger, less permeable debris barrier.

To install the above described device, the free ends of the side panels or the flaps are completely inserted into a skimmer opening until firmly secured. Preferably, the device is positioned so that the free edge of both the upper and lower screen abuts the swimming pool interior wall to prevent debris from passing therebetween. Accordingly, any debris flowing toward the skimmer opening will be trapped on either of the screens thereby preventing the debris from entering the filtering system.

Preferably, the panels are constructed with plastic though cedar or redwood could be used which will expand when wet to further secure the device within the intake. However, as will be readily apparent to those skilled in the art, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A swimming pool strainer comprising:

a substantially U-shaped base component including an end panel with a pair of parallel side panels perpendicularly extending therefrom, said end panel and said side panels each including an upper surface and a lower surface, said side panels each terminating at a free end wherein said side panels are spaced so as to tightly abut opposed inner surfaces of a skimmer intake opening to firmly anchor the base component therein;

an upper screen secured to the upper surface of said end panel and the upper surfaces of said side panels;

a lower screen attached to the lower surface of said end panel and the lower surfaces of said side panels.

2. The strainer according to claim 1 further comprising at least one spacer dowel extending between said side panels that enhance the structural integrity of the base component.

3. The strainer according to claim 1 wherein said upper screen and said lower screen each include three edges which are secured to the side and end panels using elongated L-brackets while a fourth edge is free.

4. The strainer according to claim 1 further comprising a wall inwardly extending from the free end of each side panel with a space formed between distal ends thereof;

a flap perpendicularly extending from the distal end of each wall for insertion into a swimming pool skimmer.

5. The strainer according to claim 4 wherein each flap is spaced and dimensioned so as to tightly fit within a swimming pool skimmer intake opening.

6. A swimming pool strainer comprising:

a substantially U-shaped base component including an end panel with a pair of parallel side panels perpendicularly extending therefrom, said end panel and said side panels each including an upper surface and a lower surface, said side panels each terminating at a free end;

an upper screen secured to the upper surface of said end panel and the upper surfaces of said side panels;

a lower screen attached to the lower surface of said end panel and the lower surfaces of said side panels;

a wall inwardly extending from the free end of each side panel with a space formed between distal ends thereof;

a flap perpendicularly extending from the distal end of each wall for insertion into a swimming pool skimmer wherein each flap is spaced and dimensioned so as to tightly fit within a swimming pool skimmer intake opening.

7. The strainer according to claim 6 further comprising at least one spacer dowel extending between said side panels that enhance the structural integrity of the base component.

8. The strainer according to claim 6 wherein said upper screen and said lower screen each include three edges which are secured to the side and end panels using elongated L-brackets while a fourth edge is free.

9. The strainer according to claim 6 wherein said side panels are spaced so as to tightly abut opposed inner surfaces of a skimmer intake opening to firmly anchor the base component therein.

* * * * *